US011717950B2

(12) United States Patent
Palmisano

(10) Patent No.: US 11,717,950 B2
(45) Date of Patent: Aug. 8, 2023

(54) DUAL-HEAD TOOL SYSTEM WITH ROTATABLE HANDLE

(71) Applicant: Doug Palmisano, West Palm Beach, FL (US)

(72) Inventor: Doug Palmisano, West Palm Beach, FL (US)

( * ) Notice: Subject to any disclaimer, the term of this patent is extended or adjusted under 35 U.S.C. 154(b) by 345 days.

(21) Appl. No.: 16/993,001

(22) Filed: Aug. 13, 2020

(65) Prior Publication Data

US 2021/0046629 A1 Feb. 18, 2021

Related U.S. Application Data

(60) Provisional application No. 62/886,312, filed on Aug. 13, 2019.

(51) Int. Cl.
*B25F 1/04* (2006.01)
*B25D 5/00* (2006.01)
*B25B 15/02* (2006.01)

(52) U.S. Cl.
CPC ..... *B25F 1/04* (2013.01); *B25B 15/02* (2013.01); *B25D 5/00* (2013.01)

(58) Field of Classification Search
CPC ..... B25F 1/04; B25B 15/00; B25B 15/02; B25D 5/00; B25G 1/063
See application file for complete search history.

(56) References Cited

U.S. PATENT DOCUMENTS 3,892,149 A * 7/1975 Rydberg ..... B25B 15/008 81/177.6
4,010,663 A * 3/1977 Rydberg ..... B25B 13/56 81/177.6
6,109,148 A * 8/2000 Anderson ..... B25B 15/008 7/168
6,386,075 B1 * 5/2002 Shiao ..... B25G 1/066 81/177.8
7,334,508 B2 * 2/2008 Heaven ..... B25F 1/04 81/490
7,380,660 B2 * 6/2008 Lin ..... B25G 1/085 81/177.4
8,806,990 B1 * 8/2014 Chen ..... B25G 3/18 81/177.1
9,089,955 B2 * 7/2015 Johnson ..... B25B 15/04
9,724,817 B2 * 8/2017 Hongquan ..... B25G 1/066

* cited by examiner

*Primary Examiner* — David P Bryant
*Assistant Examiner* — Christine Bersabal
(74) *Attorney, Agent, or Firm* — Allen F. Bennett; Bennett Intellectual Property

(57) ABSTRACT

A dual headed tool having a rotatable arm has a shank with a tool head at each end. The shank slides through a rotatable hub positioned at the distal ends of the tools handle. One half of the shank is inserted into a longitudinal bore extending through the handle while the other half of the shank extends outward so that the tool head at its end may be used. The shank may be slid out of the bore within the handle and rotated to alternate which end of the shank is used. The tour may also be configured without the shank extending into the longitudinal bore in the handle, such that the handle extends away from the shank at an angle between 0° and 180°.

1 Claim, 5 Drawing Sheets

DUAL-HEAD TOOL SYSTEM WITH ROTATABLE HANDLE

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to systems and apparatus's providing two tools in one. More particularly, the invention relates to devices that have two tool heads and safety features that protect the user from failure and accidental injury and allows the handle to rotate to increase torque.

Description of the Related Art

A Screwdrivers used for tightening and loosening threaded screw fasteners are well known and usually consist of a shaft or shank having a handle at one end and a driving tip at the other end for engaging a head of the screw to be driven. Usually the shank and tip are integrally formed from a single piece of steel or other strong metal. The handle is usually formed of plastic, wood or other suitable material and is permanently joined to the shaft. While these screwdrivers work well, certain jobs may require different sized or shaped tips. Several screwdrivers therefore may be needed at a particular job site for driving different type screws encountered. One also may not be certain what particular type of screwdriver is needed for a certain job, but wants to be prepared for the different screws that they may confronted with. This requires that one have on hand a set of multiple, different screwdrivers that can be used for a variety of different jobs. Because each screwdriver has its own handle and shaft, this can be cumbersome, take up a relatively large amount of space, and add to the weight of the screwdrivers that must be carried.

There are screwdrivers that utilize a single handle and shank, but that have a variety of different tips that can be interchanged on the shank. The shaft is usually provided with some type of socket, with the tip being formed as a separate bit or similar device that can be inserted and removed from the socket. Because several different bits are provided with the screwdriver, and they are usually fairly small in size, it is not uncommon that the bits become lost or misplaced. For this reason, the handles on some screwdrivers are hollowed out at the end to provide a storage compartment where the extra bits can be stored. An end cap is usually provided to close off the storage compartment. Because the extra bits are usually held loosely within this compartment, they often tend to rattle around, creating a nuisance to the user. When it is desired to select a bit from the hollowed-out storage area, it is often difficult to see the bits so that the bits must be poured out or otherwise removed from the storage area so that the appropriate bit can be selected. This increases the likelihood that the bits will be dropped and eventually lost.

In some cases, the screwdrivers may be provided with a removable shaft. A different tip can be provided at each end of the removable shank. By removing and inverting the shank, the screwdriver can be provided with at least two different tips. While removable shanks are known, there has not been a screwdriver that has an adjustable length shank that can be effectively secured to the handle.

Other designs provide for a shaft having a tool head at each opposite end. The shaft may be removed, turned around, and reinserted into the handle. Alternatively, the shaft may be slid out of opposite ends of the handle to access and use different heads. However, the mechanics of such dual use tools are often overly complex, increasing the likelihood of failure. In addition, they lack any safety features to protect a user in the case of such a failure of the locking mechanism.

None of the tools of the prior art address these design flaws. It is therefore desirable to provide a dual use tool that has a minimum of moving parts, is durable, reliable and incorporates safety features to prevent and/or mitigate failure of the locking device or other integral mechanisms.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a screwdriver having heads that are rapidly interchangeable and a handle that may be rotated to increase torque.

BRIEF SUMMARY OF THE INVENTION

Disclosed is A dual headed tool comprising a handle having a longitudinal bore extending in a proximal direction from a distal end of the handle, and a fork end of a knuckle joint extending and a distal direction from the distal end of the handle. A rotating hub forms an eye end and a pin of the knuckle joint and extends through the fork end of the knuckle joint. The rotating hub has an axis of rotation perpendicular to the longitudinal bore.

A through hole extends through the rotating hub perpendicular to the axis of rotation of the rotating hub and is alignable with the longitudinal bore of the handle. A key partially extends into the through hole. A shank has a tool head at a first end and a tool head at a second end. The shank extends through and forms a cylindrical joint or prismatic joint with the through hole of the rotating hub. A keyway extends along a side of the shank and is defined by a first shoulder proximal to the first end of the shank and a second shoulder proximal to the second end of the shank. The shank is slidable into the longitudinal bore of the handle when the longitudinal bore of the handle and the through hole of the rotating hub are aligned, thereby forming a cylindrical or prismatic joint.

It is therefore an object of the present invention to provide a dual headed tool having a rotatable handle.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
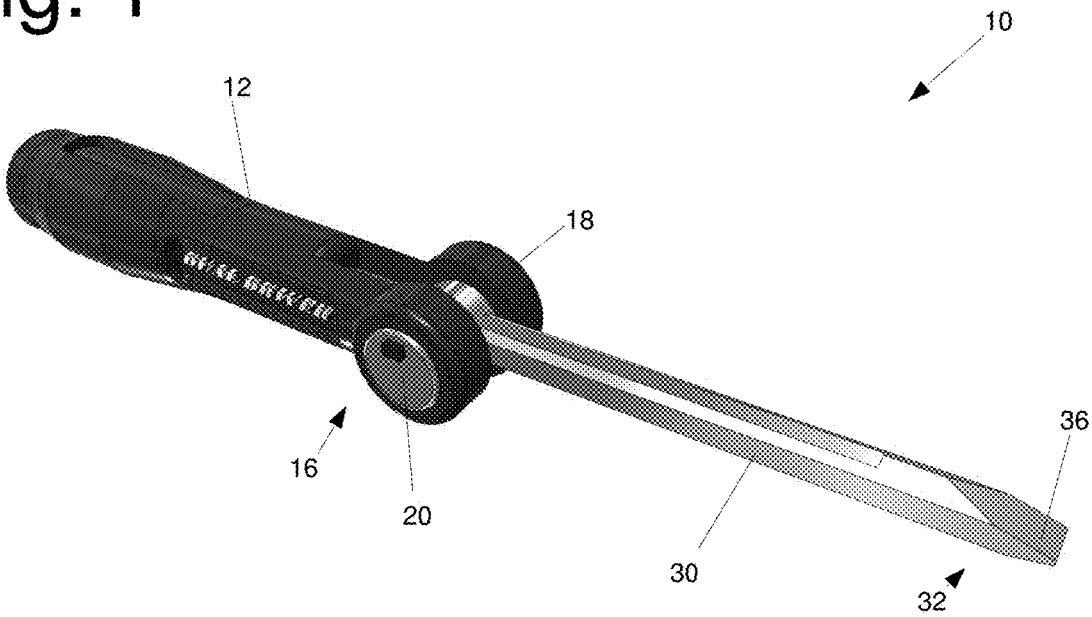
FIG. 1 is a perspective view of a dual head tool with a rotatable handle in accordance with principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

Unless otherwise indicated, all numbers expressing quantities of ingredients, dimensions reaction conditions and so forth used in the specification and claims are to be understood as being modified in all instances by the term "about". The term "a" or "an" as used herein means "at least one" unless specified otherwise. In this specification and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

Disclosed is a dual headed tool having a shank slidable through a rotating hub positioned at the distal end of the handle of the tool. One side of the shank extends into a central longitudinal bore in the handle. This holds the shank stationary while the tool head of the other side of the shank is used. The rotating hub includes a key that prevents the shank from sliding out of the rotating hub.

Figure 2:
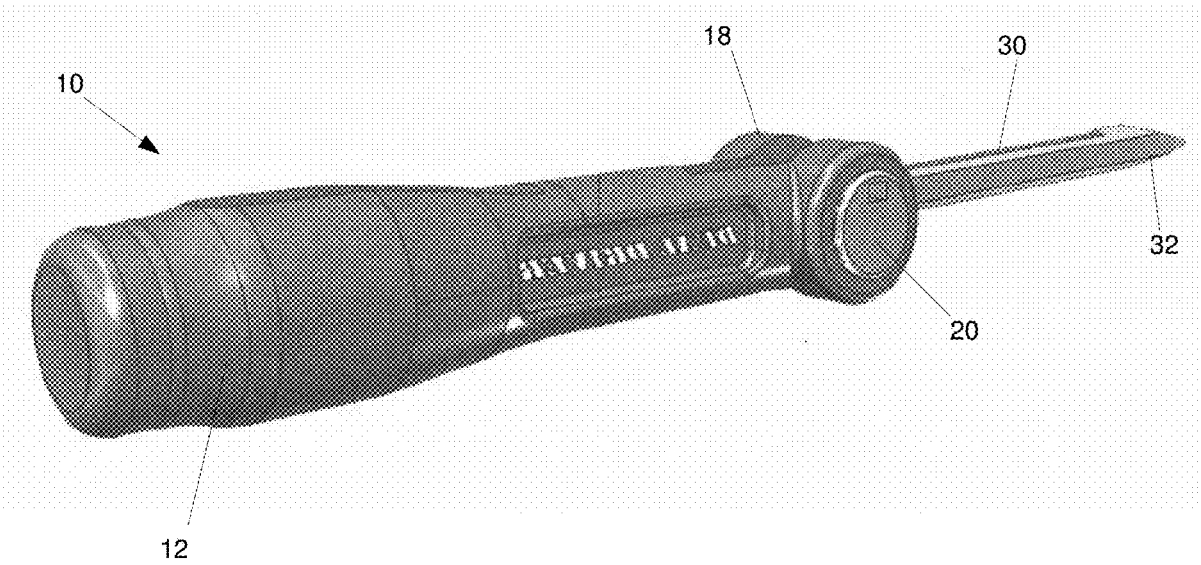
FIG. 2 is another perspective view of a dual head tool with a rotatable handle in accordance with principles of the invention.
Figure 3:
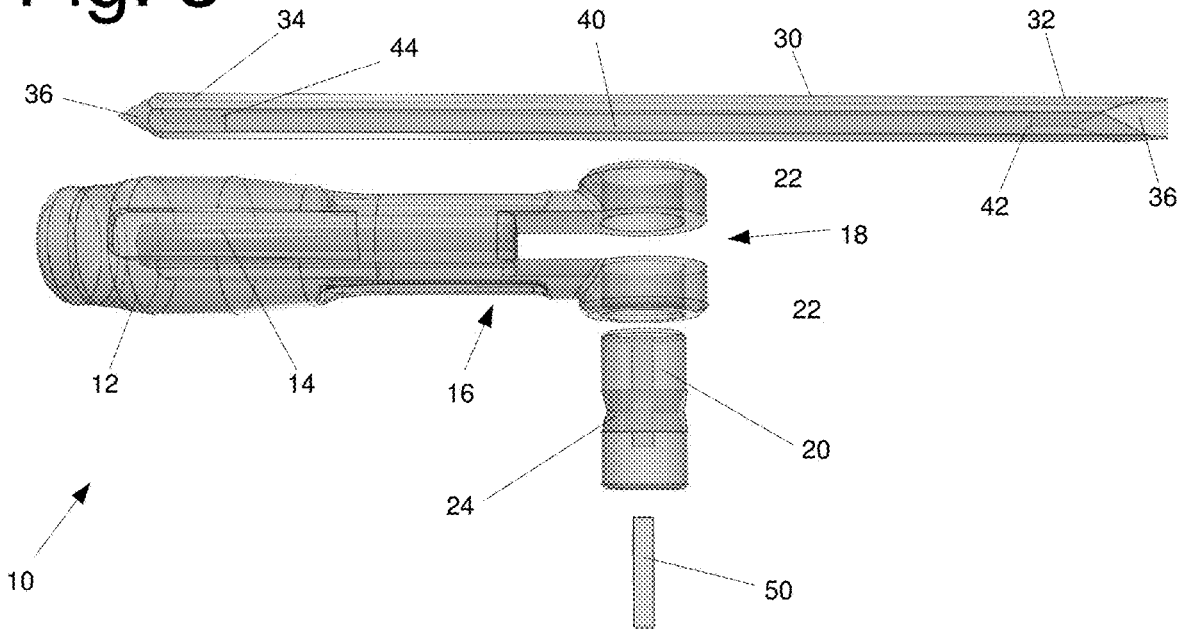
FIG. 3 is a transparent exploded view of a dual head tool with a rotatable handle in accordance with principles of the invention.
Figure 4:
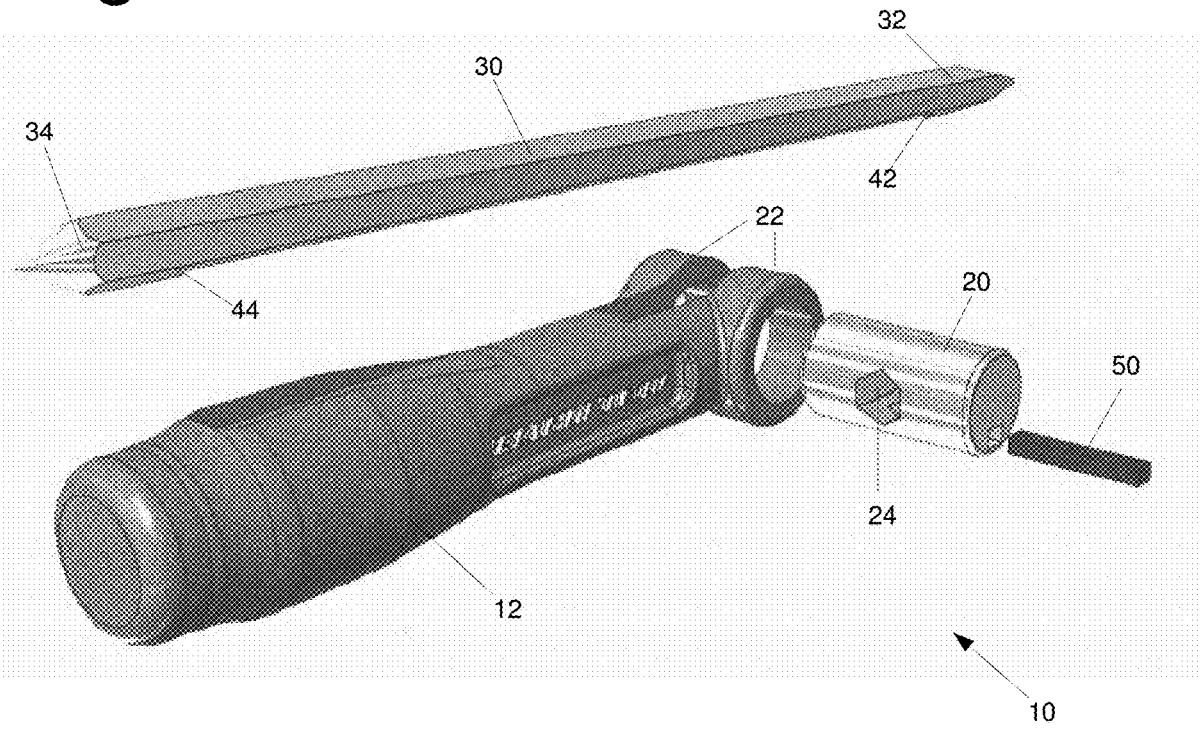
FIG. 4 is another exploded view of a dual head tool with a rotatable handle the accordance with principles of the invention.
Figure 5:
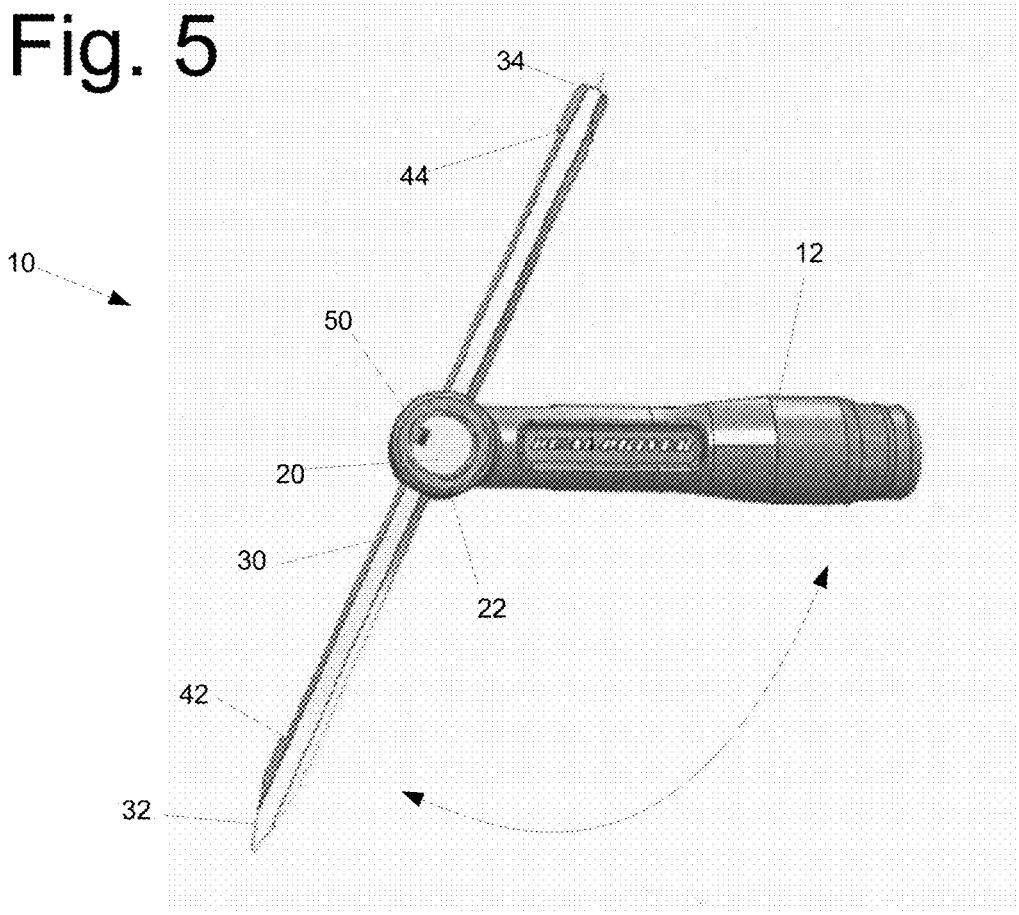
FIG. 5 is a side elevation view of a dual head tool with a rotatable handle and an alternate configuration in accordance with principles of the invention.
Figure 6:
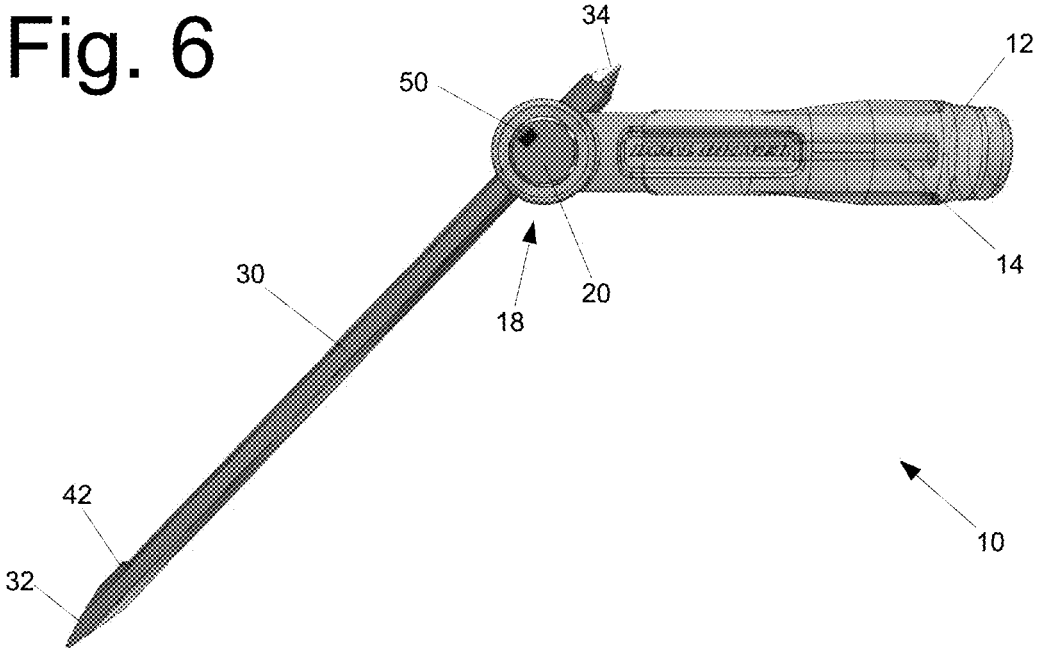
FIG. 6 is a transparent perspective view of a dual head tool with a rotatable handle in accordance with principles of the invention.
Figure 7:
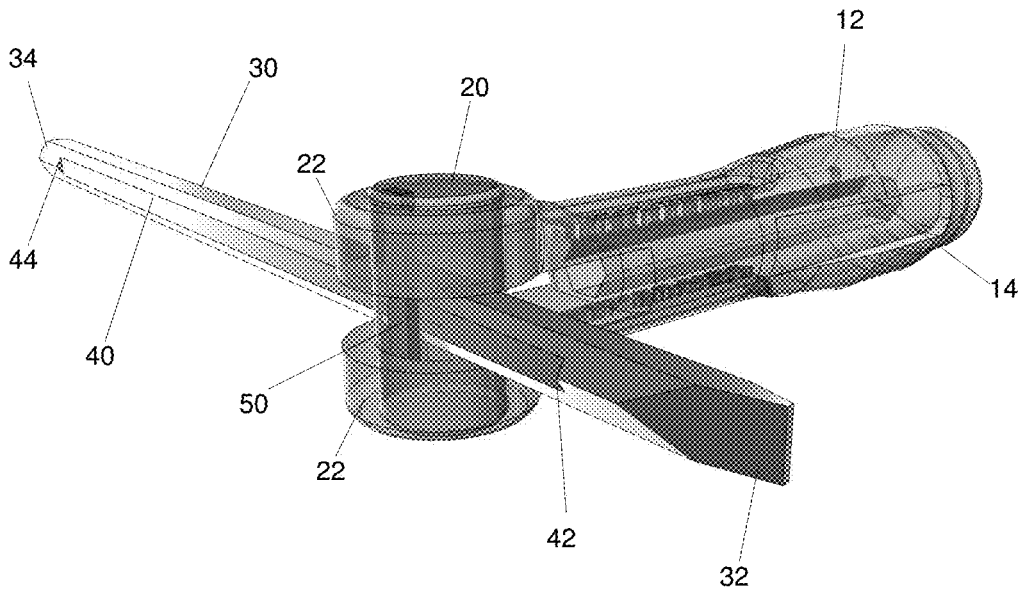
FIG. 7 is a transparent perspective view of a dual head tool with a rotatable handle in accordance with principles of the invention.
Figure 8:
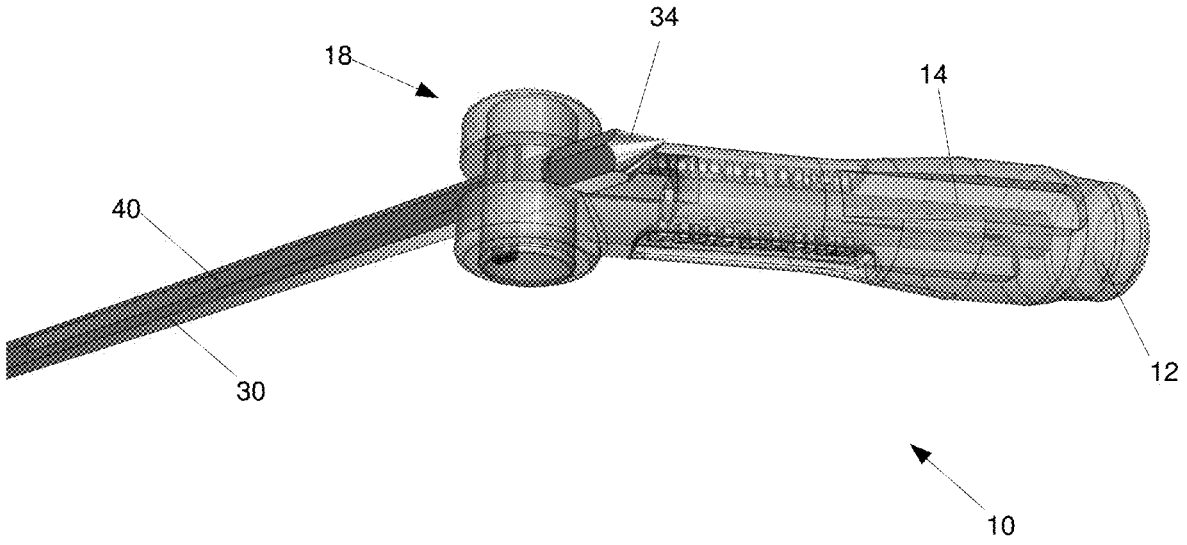
FIG. 8 is a transparent perspective view of a dual head tool with a rotatable handle in accordance with principles of the invention.
Figure 9:
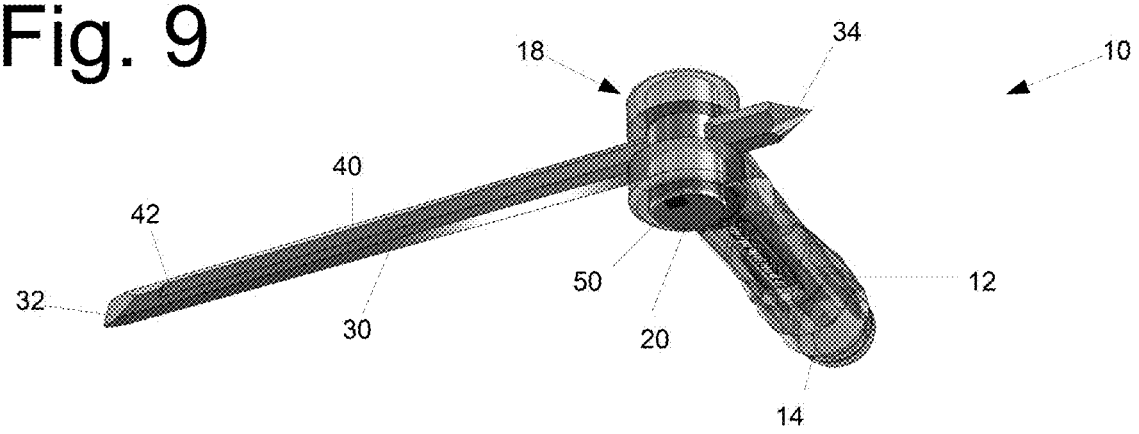
FIG. 9 is a transparent perspective view of a dual head tool with a rotatable handle in accordance with principles of the invention.
Figure 10:
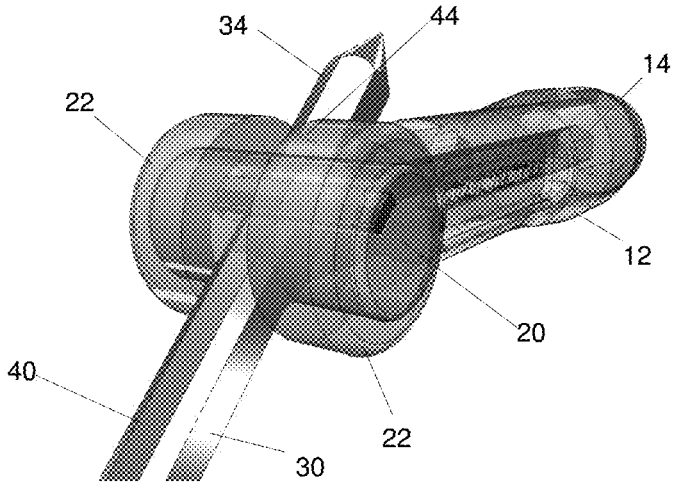
FIG. 10 is a transparent perspective view of a dual head tool with a rotatable handle in accordance with principles of the invention.
Figure 11:
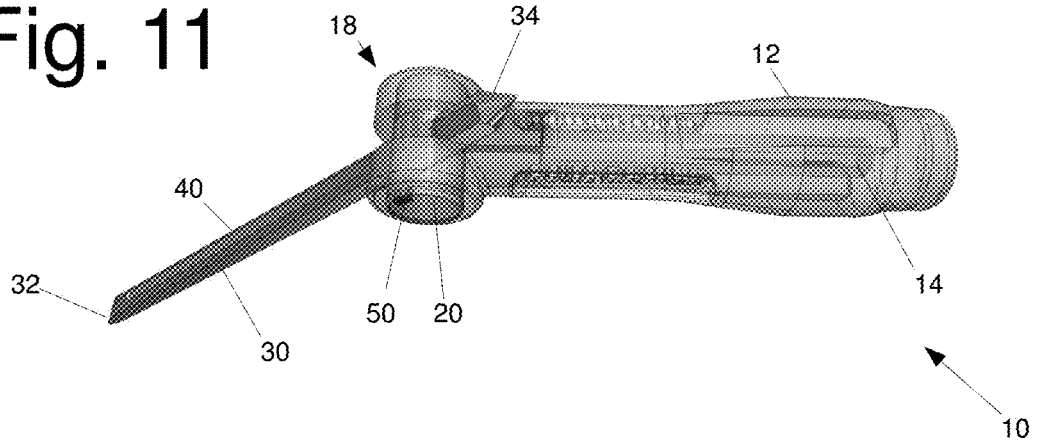
FIG. 11 is a transparent perspective view of a dual head tool with a rotatable handle in accordance with principles of the invention.

FIGS. 1-5 show a dual headed tool 10 in accordance with principles of the invention. The dual headed tool 10 has a handle 12. A central longitudinal bore 14 extends into the handle 12 proximally from the handle's distal end 16. A fork end 18 of a knuckle joint 14 extends distally from the distal end 16 of the handle 12. A rotating hub 20 extends through the eyes 22 of the fork end 18 and functions as both the eye end and pin of the knuckle joint 14. A through hole 24 extends through the rotating hub 20 in a direction perpendicular to the axis of rotation 26 of the rotating hub 20. A shank 30 has a first end 32 and a second end 34, each having a tool head 36.

The shank 30 extends through the through hole 24 of the rotating hub 20. One side of the shank 30 extends into the longitudinal bore 14 of the handle when the other side of the shank 30 extends in a distal direction. A keyway 40 runs along one side of the shank 30 and is defined by a first shoulder 42 proximal to the first end 32, and a second shoulder 44 proximal to the second end 34. A key 50 extends through the rotating hub 20 and partially obstructs the through hole 24. The extent to which the shank 30 slides is limited by key 50 abutting against the first shoulder 42 and the second shoulder 44. The shank 30 forms either a cylinder joint or a prismatic joint with both the through hole 24 and the longitudinal bore 14.

In use, one configuration of the dual headed tool 10 is provided when the through hole 24 of the rotating hub 20 is aligned with the longitudinal bore 14 and a first end 32 of the shank 30 is slid into the longitudinal bore 14. The second end 34 extends in a distal direction from the handle 12. The cylinder or prismatic joints formed by the shank 30 and the through hole 24 and/or the longitudinal bore 14. The longitudinal bore 14 may include a locking mechanism to prevent the shank 30 from sliding when the tool 10 is being used.

Another configuration of the dual headed tool 10 is provided when the shank 30 is slid distally, removing the first end 32 from the longitudinal bore 14. The rotating hub 20 is then rotated 180° and the second end 34 is inserted into the longitudinal bore 14.

Another configuration of the dual headed tool 10 is provided when the shank 30 is slid out of the longitudinal bore 14 and the rotating hub 20 is rotated more or less than 180°. The handle 12 may be positioned at an acute, perpendicular or obtuse angle relative to the shank 30. This configuration allows an operator to increase the torque applied to the shank 30.

Whereas, the present invention has been described in relation to the drawings attached hereto, other and further modifications, apart from those shown or suggested herein, may be made within the spirit and scope of this invention. Those skilled in the art will appreciate that the conception, upon which this disclosure is based, may readily be utilized as a basis for the designing of other structures, methods and systems for carrying out the several purposes of the present invention. Descriptions of the embodiments shown in the drawings should not be construed as limiting or defining the ordinary and plain meanings of the terms of the claims unless such is explicitly indicated. The claims should be regarded as including such equivalent constructions insofar as they do not depart from the spirit and scope of the present invention.

The invention claimed is:

1. A dual headed tool comprising:

a handle having a longitudinal bore extending in a proximal direction from a distal end of the handle, and a fork end of a knuckle joint extending in a distal direction from the distal end of the handle;

a rotating hub forming an eye end and a pin of the knuckle joint and extending through the fork end of the knuckle joint, the rotating hub having an axis of rotation perpendicular to the longitudinal bore;

a through hole extending through the rotating hub and perpendicular to the axis of rotation of the rotating hub, the through hole being alignable with the longitudinal bore of the handle;

a key partially extending into the through hole;

a shank having a tool head at a first end and a tool head at a second end, the shank extending through and forming a cylindrical joint or prismatic joint with the through hole of the rotating hub;

a keyway extending along a side of the shank and defined by a first shoulder proximal to the first end of the shank and a second shoulder proximal to the second end of the shank;

wherein the shank is slidable into the longitudinal bore of the handle when the longitudinal bore of the handle and the through hole of the rotating hub are aligned, thereby forming a cylindrical or prismatic joint, and wherein the rotating hub is rotatable such that the through hole therein may be positioned out of alignment with the longitudinal bore in order to position the shank at an angle with respect to the handle.

* * * * *